United States Patent [19]

Schuitemaker et al.

[11] 3,972,351

[45] Aug. 3, 1976

[54] VISCOSITY COMPENSATING OIL BURNER CONTROL SYSTEM

[75] Inventors: Theodore Schuitemaker, San Rafael; Raymond B. Plass, Piedmont, both of Calif.

[73] Assignee: Ray Oil Burner Co., San Francisco, Calif.

[22] Filed: July 30, 1975

[21] Appl. No.: 600,131

[52] U.S. Cl. ..... 137/625.47; 418/181; 431/12

[51] Int. Cl.[2] ..... F16K 11/02

[58] Field of Search ..... 431/89, 90, 12; 137/625.47, 79; 418/181, 137, 418

[56] References Cited

UNITED STATES PATENTS

| | | | |
|---|---|---|---|
| 2,000,580 | 5/1935 | Carruthers | 431/12 |
| 2,067,346 | 1/1937 | Rovimsky | 137/79 |
| 3,840,323 | 10/1974 | Eckerle | 431/90 |

*Primary Examiner*—Edward G. Favors
*Attorney, Agent, or Firm*—Phillips, Moore, Weissenberger, Lempio & Strabala

[57] ABSTRACT

A burner control system comprises a housing defining a reservoir therein and primary and secondary pumps disposed in the reservoir for pumping oil through a viscosity valve and into a burner. The outlet side of the primary pump communicates pressurized oil to the inlet side of the secondary pump directly via intercommunicating conduit means. A back pressure valve communicates with the conduit means to substantially equalize the oil pressure between the inlet and outlet of the secondary pump, discharging the excess oil capacity back into the reservoir.

7 Claims, 2 Drawing Figures

VISCOSITY COMPENSATING OIL BURNER CONTROL SYSTEM

BACKGROUND OF THE INVENTION

This invention relates to a burner control system of the type disclosed in applicant's U.S. Pat. No. 3,092,146. The system illustrated in such patent comprises a primary pump for drawing oil from a supply line, in a quantity in excess of the capacity of a secondary pump, into a reservoir wherefrom the independent secondary pump communicates such oil from the reservoir, through a viscosity valve and into a burner for firing purposes. Such system functions satisfactorily to supply oil at a substantially constant flow rate for most burner applications for burning designated "heavy oils" at pumpable viscosities varying from approximately 50 to 500 Saybolt Universal Seconds or 11 to 50 Saybolt Furol Seconds. Various local regulations have now dictated that such systems must be capable of compensating for oil having a wider range of viscosities extending into the lighter bands, as low as 30 Saybolt Universal Seconds.

As shown in FIG. 2 of the drawings which illustrates a standard ASTM viscosity chart for fuel oil, such viscosities may range from the relatively light "No. 2 max." to the heavier "No. 6 max.". Although the secondary pump is of positive displacement type for pumping a constant volume of oil to the viscosity valve, a certain amount of slippage may occur therein as a result of the differential pressure required on the respective sides of the secondary pump. There may be intolerable leakage when handling oil having viscosities substantially below customary values.

SUMMARY OF THIS INVENTION

An object of this invention is to provide an improved burner control system with means for compensating for changes in the viscosity of oils communicated from a secondary pump to a viscosity valve thereof. An inlet side of the secondary pump communicates directly with an outlet side of a primary pump via intercommunicating conduit means with the primary pump functioning to draw excess oil into the system. A back pressure valve means communicates with the conduit means for maintaining oil pressure at the inlet substantially equal to the outlet side of the secondary pump notwithstanding the specified viscosity variation.

BRIEF DESCRIPTION OF THE DRAWING

Other objects of this invention will become apparent from the following description and accompanying drawing wherein.

DETAILED DESCRIPTION

Figure 1:
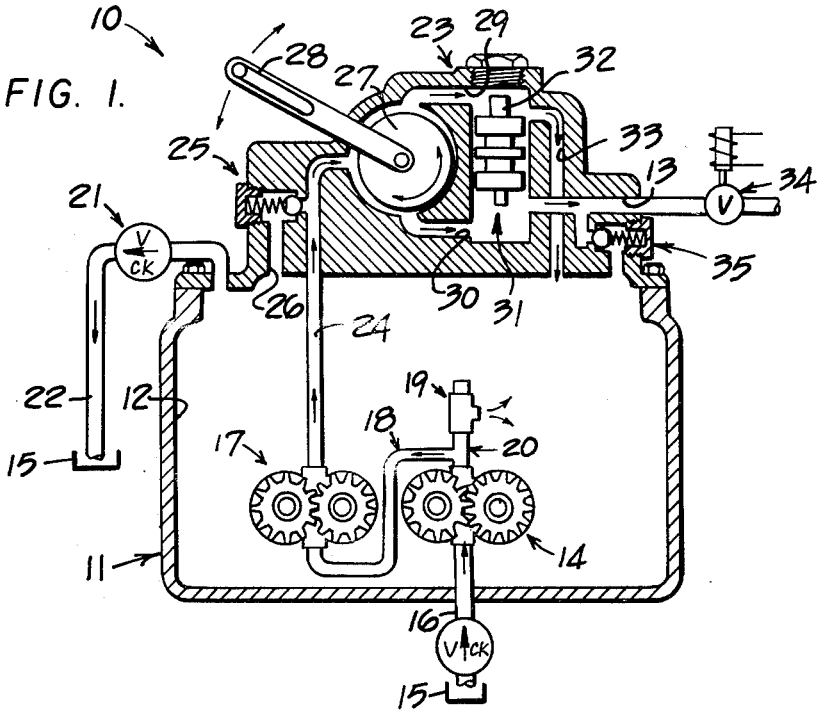
FIG. 1 is a partially schematic and cut-away view of a burner control system embodying this invention.

FIG. 1 illustrates a burner control system 10 of the type generally shown in applicant's U.S. Pat. No. 3,092,146. The system comprises a housing 11 defining a reservoir 12 therein and an outlet 13 adapted to communicate fuel oil to a burner tip (not shown) disposed in the fire box of a heat receiver. The rate of oil flow through outlet 13 will determine the heat output of the flame in the fire box and is precisely adjusted and controlled to assure a constant rate of burning for any given setting.

A primary pump 14 draws oil from a tank or supply line 15 to an inlet side thereof via a check valve and inlet conduit 16. The outlet side of the primary pump intercommunicates with an inlet side of a secondary pump 17 via conduit means 18 which may comprise a suitably drilled passageway formed in the body of a casing which houses both of the primary and secondary pumps therein (schematically illustrated). A back pressure valve 19 communicates with conduit means 18 by means of a conduit 20 operatively interconnected therebetween.

Each of the pumps is preferably of the positive-displacement and constant volume type having capacities exceeding the maximum requirements at outlet 13. The pumps and back pressure valve are preferably mounted in reservoir 12 which is adapted to return excess oil when the capacity of the primary pump exceeds that of the burning rate. The excess oil will flow back to tank or return line 15 via a check valve 21 and return line connection 22.

The outlet side of secondary pump 17 communicates with the inlet side of a viscosity valve means 23 via a conduit 24. A relief valve 25 is adapted to relieve excess pressures above normal operating conditions by communicating oil back to reservoir 12 via a passage 26. The viscosity valve comprises a regulating or viscous-flow eccentric disc 27 adapted to be rotated selectively by a flow regulator, comprising a lever 28 which sets the flow rate of the oil to match the required firing rate.

As fully described in above-referenced U.S. Pat. No. 3,092,146, the regulating disc functions to apportion pressurized oil communicated thereto from passage 24, between respective first and second outlet passages 29 and 30 on the outlet side thereof. A pressure balancing valve 31 comprises a spool 32 adapted to substantially equalize the oil pressures in passages 29 and 30, in effect producing the same pressure drop through the two restricted, tapered viscosity passages from 24 to 29 and 30 respectively, thus producing the proportional flow patterns. If the pressure in passage 30 becomes greater than the pressure in passage 29, the spool will rise, reducing the size of the inlet to a passage 33 until the pressure in passage 29 becomes equal to that in passage 30. If the pressure in passage 29 exceeds that in passage 30, the spool will be forced downwardly, reducing the size of the inlet opening to outlet 13 to raise the pressure in passage 30 until it equals that in passage 29.

In operation, primary pump 14 functions to deliver oil into reservoir 12 and to secondary pump 17, from a pressure in the supply line varying from a negative value of approximately 8″Hg to a positive pressure of about 10 psi. The primary pump then pressurizes such oil to a pressure of approximately 30 psi above the pressure in reservoir 12, upon its communication to conduit means 18. Back pressure valve 19 functions to relieve the excess volume of oil delivered by primary pump 14 over the capacity of secondary pump 17, into reservoir 12. The pressure in conduit means 18 is thus maintained at the above-mentioned approximate value of 30 psi above that in the reservoir.

Secondary pump 17 receives the pressurized oil at the inlet side thereof and communicates the same to conduit 24. The secondary pump will then function as a metering pump in cooperation with back pressure valve 19 to substantially equalize the pressures on the inlet and outlet sides thereof. In actual practice, the pressure in conduit 18, relative to ambient, will vary as the return line pressure changes, being reflected in reservoir 12. This change is compensated by the action of pressure balance valve 32 to equalize the pressure drop through the two tapered viscosity passages.

Figure 2:
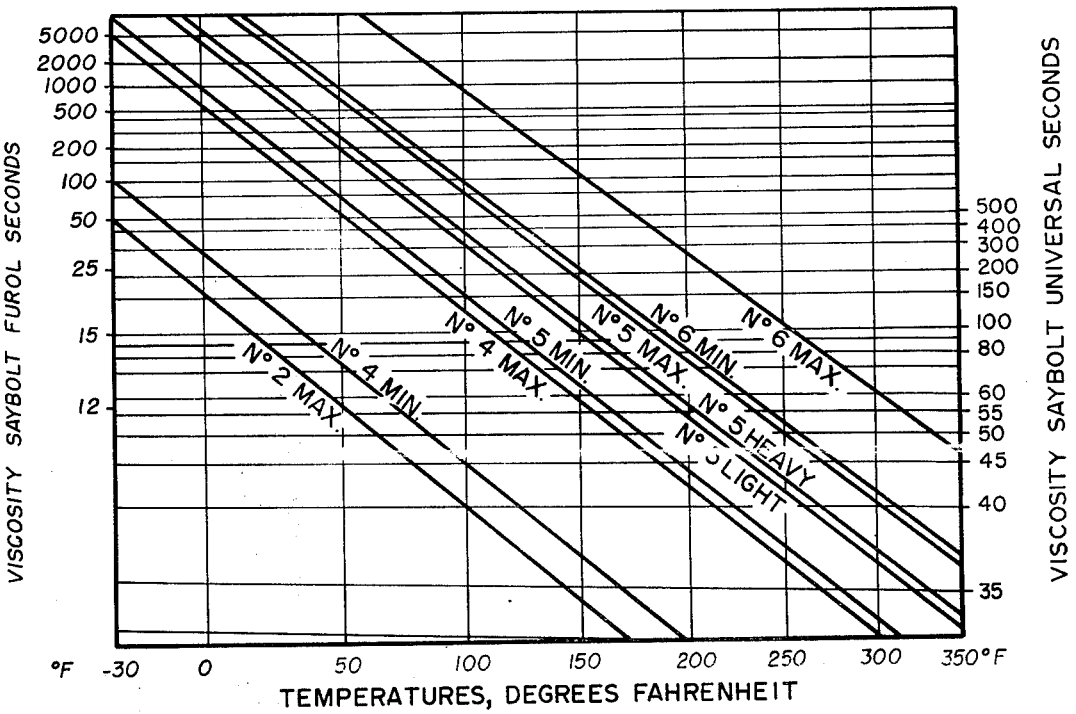
FIG. 2 graphically illustrates comparative viscosity characteristics of fuel oils.

The oil then proceeds through the viscosity valve and is communicated to outlet 13 and through a solenoid-actuated shut-off valve 34 at a pressure required for atomization of the oil at the nozzle (not shown) which varies with the firing rate of the burner. A pressure relief valve 35 is adapted to relieve excess pressures in the outlet. As stated above, the control system of this invention is adapted to assure a substantially constant flow rate of oil out of outlet 13, even though the viscosity of such oil is within the "lighter" ranges illustrated in FIG. 2, with a set position of the flow rate lever 28.

We claim:

1. In a burner control system of the type comprising primary pump means for drawing oil into an inlet side thereof, secondary pump means, an outlet adapted for connection to a burner to communicate pressurized oil thereto and viscosity valve means intercommunicating between an outlet side of said secondary pump and said outlet for communicating a controlled rate of oil flow to said outlet, the improvement comprising conduit means intercommunicating an outlet side of said primary pump means with an inlet side of said secondary pump means directly and back pressure valve means communicating with said conduit means for maintaining oil pressure at the inlet and outlet sides of said secondary pump means at substantially equal levels.

2. The burner control system of claim 1 further comprising a housing defining a reservoir therein and wherein said primary and said secondary pump means are each mounted within said reservoir.

3. The burner control system of claim 2 wherein said back pressure valve means is mounted in said reservoir.

4. The burner control system of claim 2 wherein said viscosity valve means comprises regulating disc means rotatably mounted in said housing and communicating at an inlet side thereof with the outlet side of said secondary pump means.

5. The burner control system of claim 4 wherein said viscosity valve means further comprises first and second outlet passages communicating with an outlet side of said regulating disc means and further communicating with respective ends of pressure balancing valve means, said second outlet passage communicating with said outlet directly.

6. The burner control system of claim 1 wherein said secondary pump means constitutes a positive-displacement and constant volume pump.

7. The burner control system of claim 1 wherein said primary pump means constitutes a positive-displacement and constant volume pump.

* * * * *